US006619081B1

(12) United States Patent
Yu

(10) Patent No.: US 6,619,081 B1
(45) Date of Patent: Sep. 16, 2003

(54) STEEL CABLE LOCK STRUCTURE

(76) Inventor: Chun Te Yu, No. 41-21, Kuan-Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 0 days.

(21) Appl. No.: 10/119,217

(22) Filed: Apr. 10, 2002

(30) Foreign Application Priority Data

Dec. 31, 2001 (TW) ..... 90224105 U

(51) Int. Cl.[7] ..... E05B 69/00; E05B 73/00
(52) U.S. Cl. ..... 70/58; 70/14; 70/18
(58) Field of Search ..... 70/58, 22–29, 70/424–426, 231, 165, 14, 18

(56) References Cited

U.S. PATENT DOCUMENTS

| | | | | | |
|---|---|---|---|---|---|
| 5,063,760 | A | * | 11/1991 | Horita et al. | 70/23 |
| 5,327,752 | A | * | 7/1994 | Myers et al. | 70/58 |
| 5,381,685 | A | * | 1/1995 | Carl et al. | 70/58 |
| 5,493,878 | A | * | 2/1996 | Murray et al. | 70/58 |
| 5,502,989 | A | * | 4/1996 | Murray et al. | 70/58 |
| 5,791,171 | A | * | 8/1998 | Kelley | 70/58 |
| 5,875,657 | A | * | 3/1999 | Kelley | 70/18 |
| 5,983,679 | A | * | 11/1999 | Reyes | 70/58 |
| 6,006,557 | A | * | 12/1999 | Carl et al. | 70/58 |
| 6,058,744 | A | * | 5/2000 | Ling | 70/28 |
| 6,244,080 | B1 | * | 6/2001 | Sakurai | 70/14 |
| 6,257,029 | B1 | * | 7/2001 | Liao | 70/58 |
| 6,305,199 | B1 | * | 10/2001 | Igelmund | 70/58 |
| 6,401,502 | B1 | * | 6/2002 | Yang | 70/30 |
| 6,449,992 | B1 | * | 9/2002 | Yu et al. | 70/58 |
| 6,463,770 | B1 | * | 10/2002 | Lee | 70/58 |

FOREIGN PATENT DOCUMENTS

| | | | |
|---|---|---|---|
| TW | 370147 | * | 9/1999 |
| TW | 413259 | * | 11/2000 |
| TW | 424840 | * | 3/2001 |
| TW | 435561 | * | 5/2001 |
| TW | 435725 | * | 5/2001 |

* cited by examiner

*Primary Examiner*—Lynne H. Browne
*Assistant Examiner*—John B Walsh
(74) *Attorney, Agent, or Firm*—Troxell Law Office PLLC

(57) ABSTRACT

Steel cable lock structure having an inner stop member movably and relatively rotatably fitted with one end of a lock casing. The center of the inner stop member is formed with a cross-shaped perforation. A core shaft extends through the perforation to rotatably connect with a driving member drivingly connected with the lock core. The circumference of the core shaft is formed with axially extending lateral ribs that extend into guide channels on the at least one lock bolt to connect the at least one lock bolt with the core shaft and enhance torque strength of the lock bolt structure. The core shaft is driven by the driving member to make an outward extending hook section of the at least one lock bolt lock or unlock a lock bolt hole of an article.

31 Claims, 7 Drawing Sheets

STEEL CABLE LOCK STRUCTURE

BACKGROUND OF THE INVENTION

The present invention is related to an improved steel cable lock structure in which the lock bolts and relevant driving structure are rotatable relative to the casing and lock core so as to avoid damage of the lock bolts or the lock bolt hole of the locked article due to twisting force applied to the casing.

Taiwanese Patent Publication Nos. 370147, 413259, 424840, 435561, 435725 and U.S. Pat. No. 5,502,989 disclose various steel cable lock structures. These steel cable lock structures can be substantially divided into several kinds as follows:

1. A fixed lock bolt is disposed on the casing in cooperation with a movable lock bolt. The movable lock bolt can be extended from the fixed lock bolt and engaged in a hole formed on an article to achieve a locking effect (such as Taiwanese Publication Nos. 370147 and 424840).
2. Two relatively movable lock bolts (lock plates) can be expanded to engage in a hole formed on an article to be locked so as to achieve a locking effect (such as Taiwanese Publication Nos. 413259 and 435561 and an embodiment of U.S. Pat. No. 5,502,989).
3. The rear end of the lock casing is formed with an axially projecting latch block. The lateral faces of the latch block are formed with slide channels. Two corresponding corners of the latch block are formed with latch projections for engaging with inner wall face of the computer housing. A pin fitted with a restoring spring is extensible/retractable in the slide channels of the latch block. When a lock bolt is inserted into a preset hole, the pin is moved out to make the latch block deflect by a certain angle to engage with inner side of the hole (such as Taiwanese Publication No. 435724).
4. One end of a lock bolt is formed with an elongated transversely extending stop bar. The lock bolt is pivotally extended into a slot preformed on an article to be locked. By means of rotating the lock bolt, the stop bar is rotated by a certain angle to intersect the slot to achieve a locking effect (such as an embodiment of U.S. Pat. No. 5,502,989).

The above lock structures have a common characteristic, that is, the lock bolt has a certain strength against an external force applied onto the lock bolts to draw the lock bolts out of the hole of the article. However, the fixed lock bolt and movable lock bolt (or two movable lock bolts) are separately arranged. In the case the lock body is forcedly turned, the lock bolts tend to be permanently twisted and deformed. As a result, the lock bolt will lose its locking effect and can be easily drawn out of the hole of the article. Even if the material of the lock bolt is reinforced or the shape of the lock bolt is such designed as to increase the torque strength of the lock bolt, the hole of the article will be eventually damaged to lose the locking effect. Moreover, the change of material or design of shape will lead to increased cost for material and increased manufacturing cost.

SUMMARY OF THE INVENTION

It is therefore a primary object of the present invention to provide an improved steel cable lock structure. An inner stop member is relatively rotatably fitted with one end of the lock casing. A core shaft extendably/retractably extends through the center of the inner stop member. An outward extending end of the core shaft is formed with an expansion section. A front cap is cooperatively fitted with the inner stop member to restrict at least one lock bolt pivotally rotatable relative to the front cap. The outer ends of the lock bolts are formed with outward extending hook sections. The core shaft can extend or retract to deflect the lock bolts. Accordingly, the hook sections of the lock bolts can expand to lock a lock bolt hole of an article or contract to unlock the lock bolt hole. The lock casing and the inner stop member are rotatable relative to each other so as to avoid damage of the lock bolts or the lock bolt hole of the locked article due to twisting force applied to the casing.

It is a further object of the present invention to provide the above steel cable lock structure in which the lock bolts are formed with guide channels on inner opposite faces. The circumference of the core shaft is formed with axially extending lateral ribs which can at least partially extend into the guide channels to connect the lock bolts with the core shaft. The strengths of the lock bolts and the core shaft are combined to enhance torque strength of the lock bolt structure so as to avoid damage of the lock bolts or the lock bolt hole of the locked article due to twisting force applied to the casing.

The present invention can be best understood through the following description and accompanying drawings wherein:

DETAILED DESCRIPTION OF THE PREFERRED EMBODIMENTS

Figure 1:
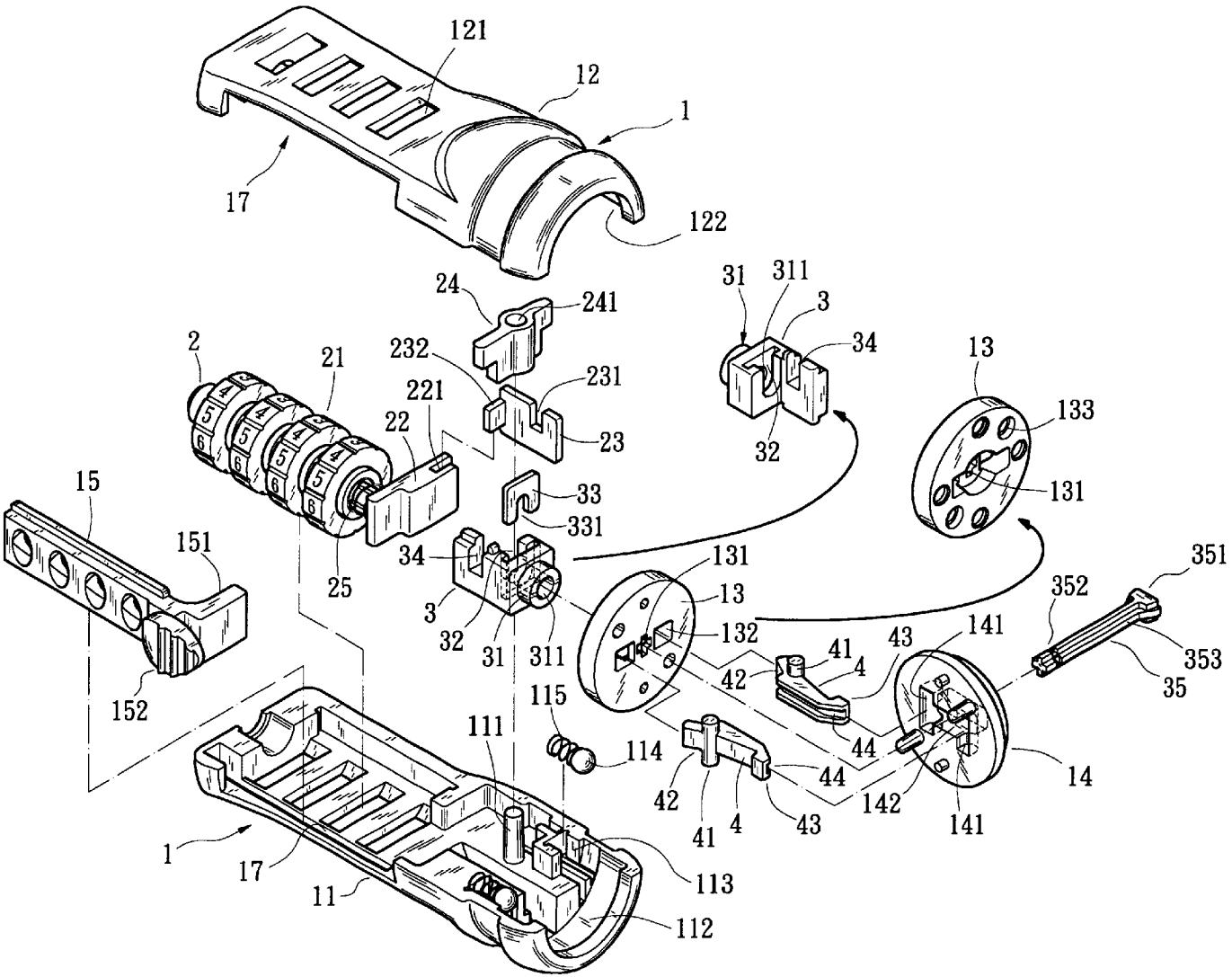
FIG. 1 is a perspective exploded view of the present invention.

Please refer to FIG. 1. According to a preferred embodiment of the present invention, the steel cable lock structure includes a casing 1, a lock core 2, a driving member 3 and two lock bolts 4. The casing 1 is composed of a base seat 11, an upper cover 12, an inner stop member 13, a front cap 14 and a shift member 15. One end of the base seat 11 is formed with an opening. The inner side of the opening is formed with an annular recess 112. Two sides inside the annular recess 112 are formed with axially extending receiving cavities 113. A resilient member 115 is disposed in each receiving cavity 113 for pushing a ball body 114 toward the annular recess 112. A projecting post 111 is disposed on a middle portion of inner side of the base seat 11. One end of the upper cover 12 is also formed with an opening. The inner side of the opening is formed with an annular recess 122. The top face of the upper cover 12 is formed with multiple wheel-turning windows 121. The center of the inner stop member 13 is formed with a cross-shaped perforation 131. Two through holes 132 are formed on two sides of the perforation 131. The circumference of inner face of the inner stop member 12 is formed with multiple dents 133. The front cap 14 is fitted and connected with the inner stop member 13. The center of the front cap 14 is formed with a through hole 142. Two slots 141 are formed on the inner face of the front cap 14 beside the through hole 142. The slots 141 extend in parallel to the through hole 142. One end of the shift member 15 has a perpendicularly bent push section 151. A press block 152 is formed on one side of the bent section of the push section 151. Multiple numeral wheels 21 are side by side coaxially arranged on the lock core 2 for controlling the unlocking/locking operation of the lock core 2. One end of the lock core 2 is connected with a driving section 22 pushed by a resilient member 25. The driving section 22 has a transverse extending insertion channel 221. A projecting section 232 of a linking member 23 is inserted and connected in the insertion channel 221. A middle portion of the linking member 23 is formed with an insertion slit 231. One end section of a pivoted plate 24 extends into the insertion slit 231 to drive the linking member 23. A middle portion of the pivoted plate 24 is formed with a shaft hole 241 in which the projecting post 111 of the base seat 11 is pivotally fitted. The middle portion of the driving member 3 is formed with an insertion slit 32 and an insertion recess 34 extending in parallel to the insertion slit 32. The other end of the pivoted plate 24 extends into the insertion recess 34. An engaging plate 33 having a notch 331 is inserted and located in the insertion slit 32. One end section of the driving member 3 is formed with a boss section 31 having a central through hole 311 communicating with the insertion slit 32. A core shaft 35 extends through the through hole 311. The core shaft 35 is an elongated member. One end of the core shaft 35 is formed with a gradually widened expansion section 351. The other end of the core shaft 35 is formed with an annular groove 352. The circumference of the core shaft 35 is formed with multiple axially extending ribs 353, whereby the core shaft 35 has a cross-section with a shape corresponding to the shape of the cross-shaped perforation 131. A middle portion of each lock bolt 4 is formed with a pivot section 41. One end of the lock bolt 4 is formed with an obliquely extending rear end section 42. The other end of the lock bolt 4 is formed with an outward extending hook section 43. The lock bolt 4 is formed with a longitudinally extending guide channel 44 on an inner side opposite to the hook section 43.

Figure 2:
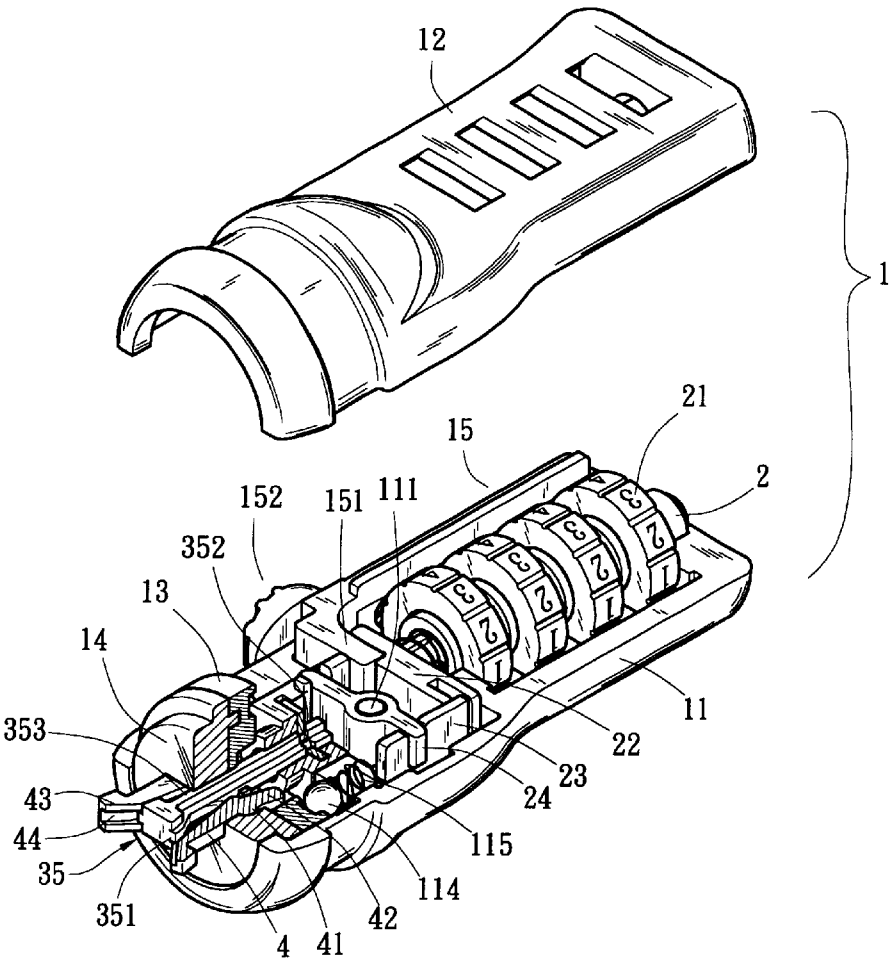
FIG. 2 is a partially assembled perspective view of the present invention.
Figure 3:
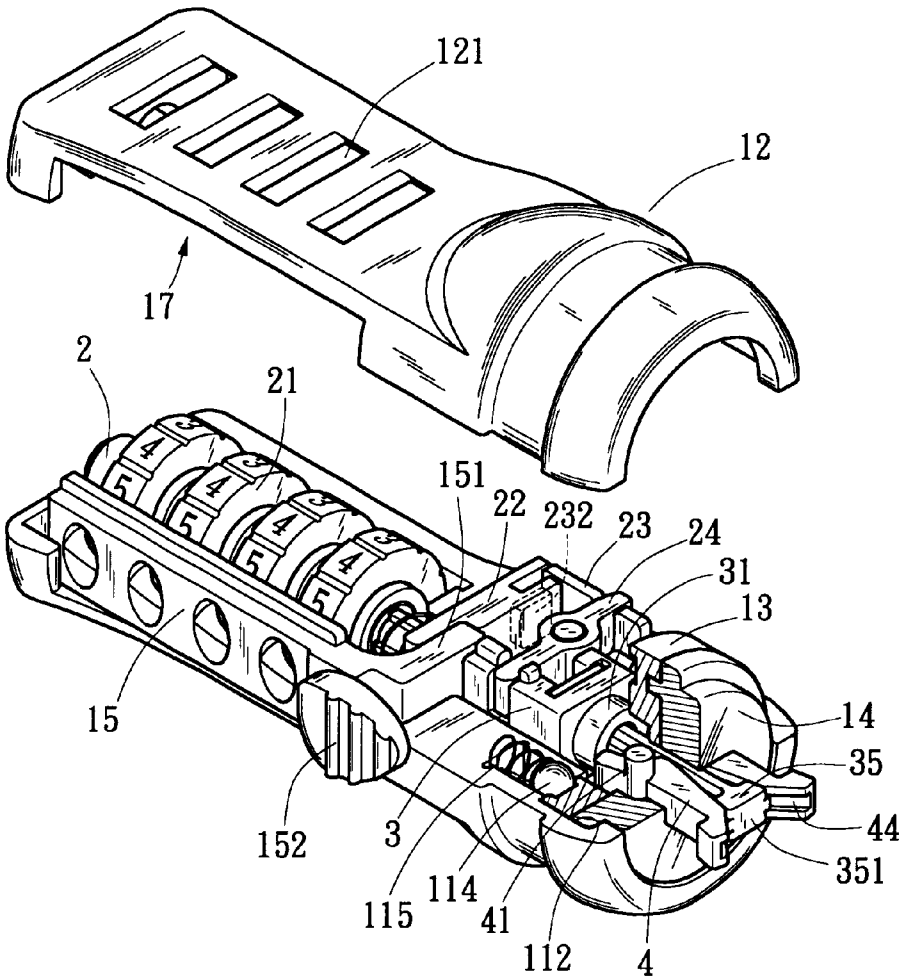
FIG. 3 is a partially assembled perspective view of the present invention seen from another angle.
Figure 4:
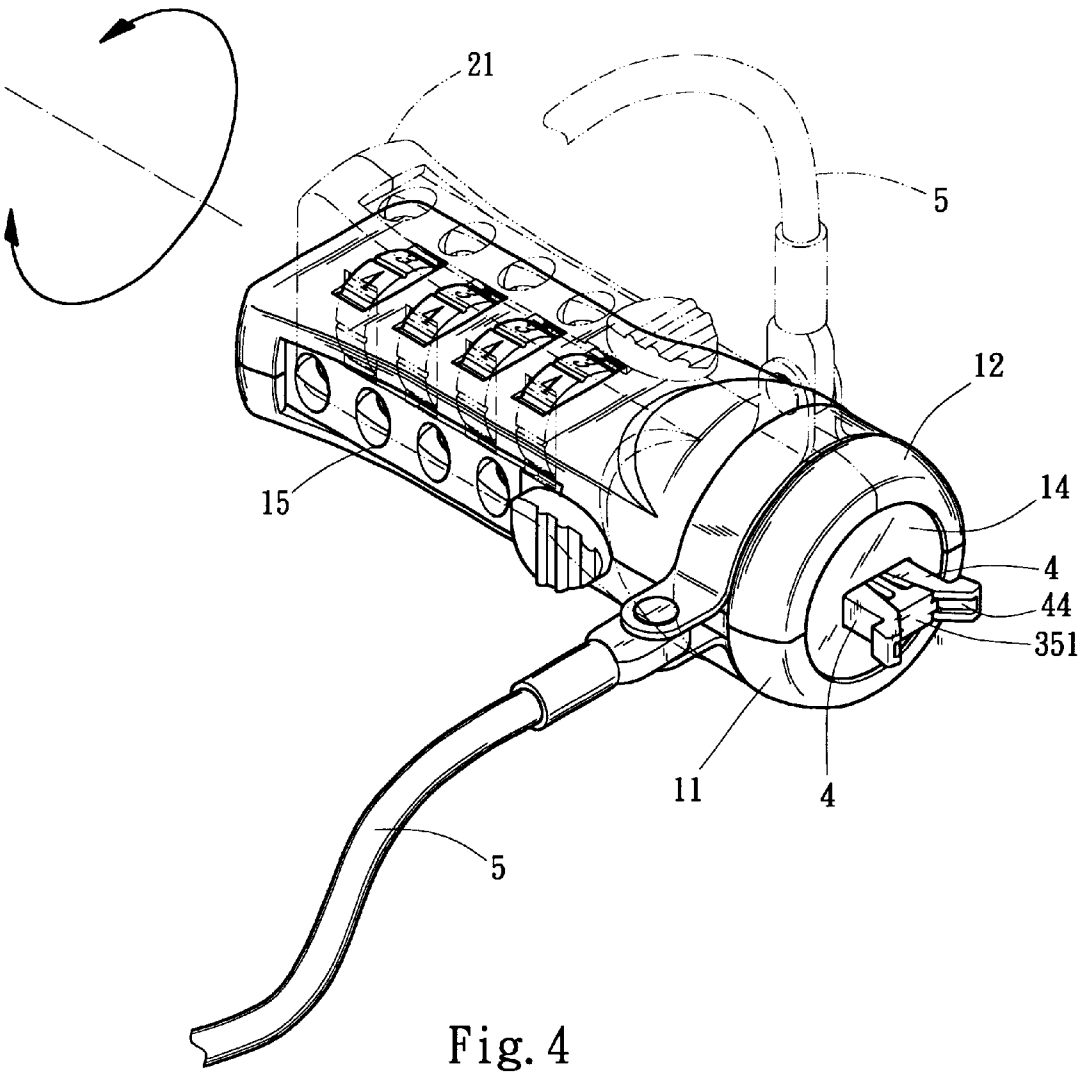
FIG. 4 is a perspective assembled view of the present invention.

Please refer to FIGS. 2, 3 and 4. When assembled, with the guide channels 44 opposite to each other, the pivot sections 41 of the two lock bolts 4 are respectively fitted into the slots 141 of the front cap 14. The hook sections 43 pass through the through hole 142 and extend outward. The front cap 14 is connected with the front face of the inner stop member 13 and the rear end sections 42 of the lock bolts 4 rearward extend into the through holes 132 of the inner stop member 13. The end of the core shaft 35 with the annular groove 352 passes through the cross-shaped perforation 131 of the inner stop member 13 and extends into the through hole 311 of the boss section 31. Via the engaging plate 33 inserted in the insertion slit 32, the notch 331 of the engaging plate 33 in the insertion slit 32 clamps the annular groove 352, whereby the core shaft 35 is drivingly connected with the driving member 3. When the core shaft 35 is located, the lateral ribs 353 of the core shaft 35 extend into the guide channels 44 of the lock bolts 4 to slidably connect the core shaft 35 with the lock bolts 4. Then the base seat 11 and the upper cover 12 are mated with each other and the annular recesses 112, 122 together clamp and embrace the circumferences of the inner stop member 13 and the front cap 14. At least one resilient member 115 pushes the ball body 114 to be inlaid in the dent 133 of the inner stop member 13. The shift member 15 is slidably clamped in a slide slot 17 between the base seat 11 and the upper cover 12. The lock core 2 is received in the casing 1. The numeral wheels 21 are partially exposed to outer side through the wheel-turning windows 121 for a user to turn the numeral wheels 21 for controlling the lock core 2. The push section 151 of the shift member 15 clamped between the base seat 11 and the upper cover 12 presses outer side of the driving section 22. The driving section 22 is drivingly connected with the driving member 3 via the linking member 23 and the pivoted plate 24 as shown in FIG. 1.

After assembled, a steel cable 5 is clamped and connected with the casing 1 to form a complete steel cable lock.

Figure 5:
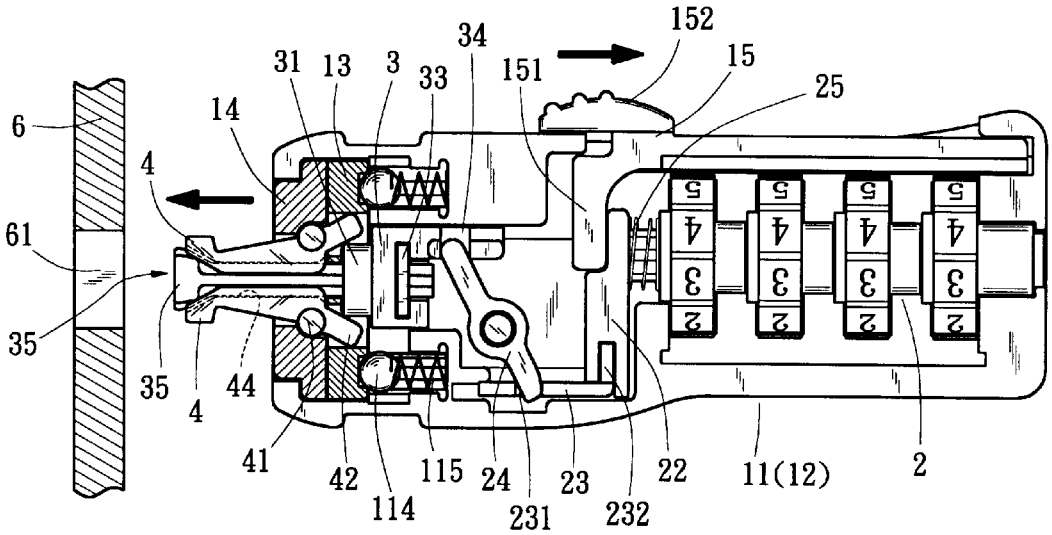
FIG. 5 is a sectional view showing the above embodiment of the present invention in unlocked state.
Figure 6:
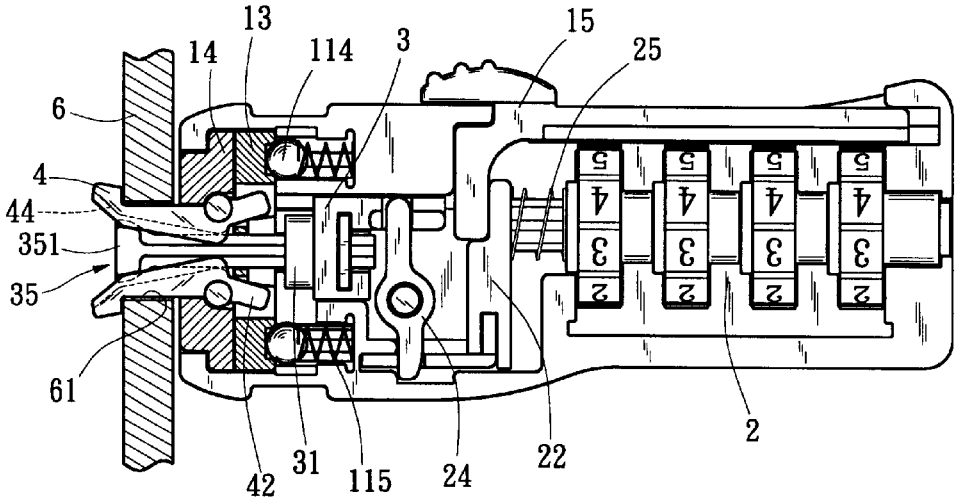
FIG. 6 is a sectional view showing the above embodiment of the present invention in locked state.
Figure 7:
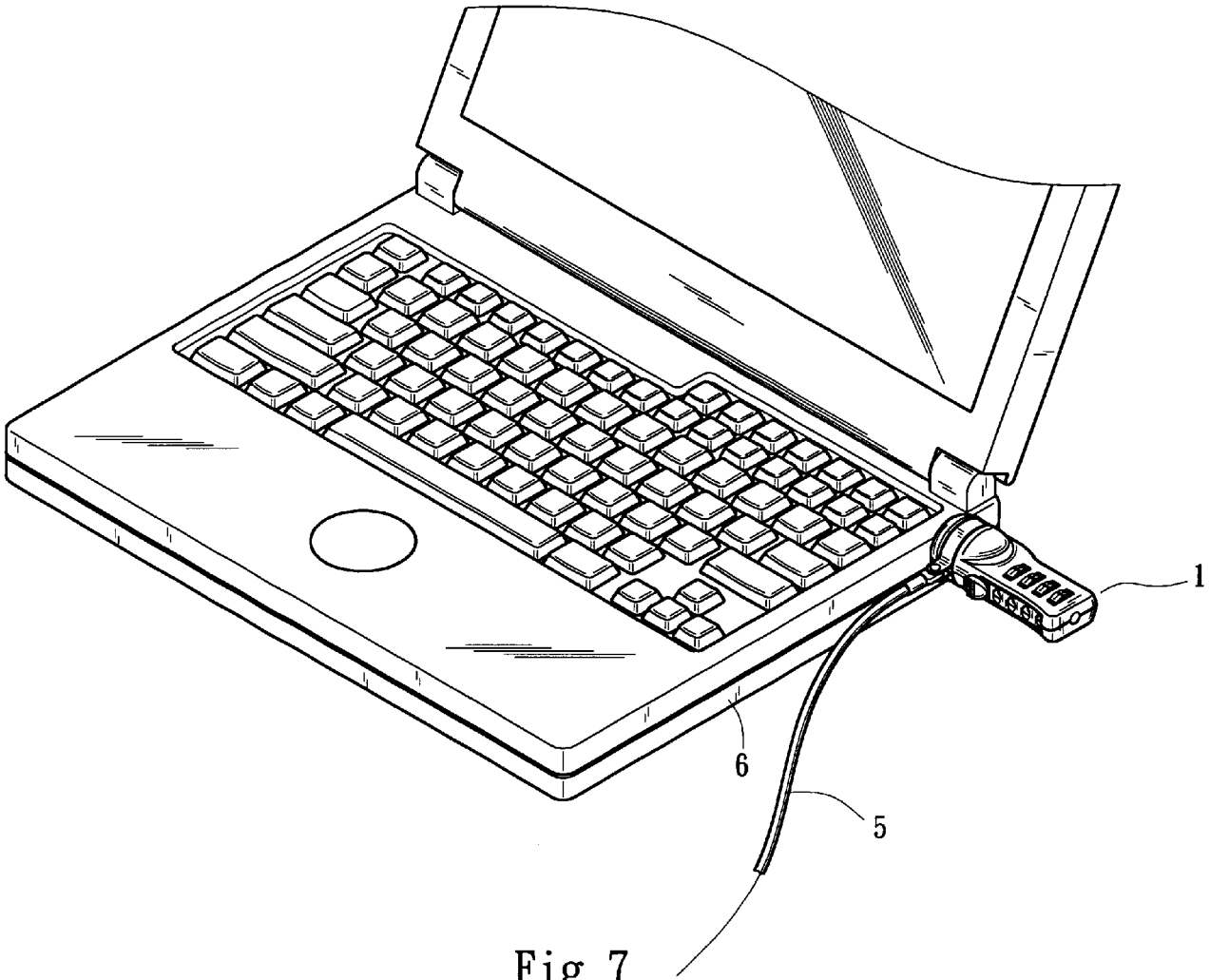
FIG. 7 shows the application of the present invention.

FIGS. 5 and 6 show the operation of the present invention. In use, in the case that a user turns the respective numeral wheels 21 to correct position, the user can press the press block 152 to push the shift member 15. At this time, the push section 151 presses the driving section 22 to drive the lock core 2 to axially displace relative to the numeral wheels 21. Via the linking member 35, the driving section 22 pulls one end of the pivoted plate 24, whereby the other end thereof reversely forward pushes the driving member 3. At this time, the driving member 3 synchronously forward pushes the core shaft 35 and the boss section 31 pushes the inner sides of the rear end sections 42 of the lock bolts 4 and makes the rear end sections 42 deflect outward. Accordingly, the other ends of the lock bolts 4 are inward deflected toward the core shaft 35. At this time, the core shaft 35 is driven by the driving member 3 and the expansion section 351 protrudes outward, whereby the lateral ribs 353 are gradually accommodated in the guide channels 44 as shown in FIG. 5 and the lock bolts 4 are fully closed onto the core shaft 35. Under such circumstance, the user can extend the hook sections 43 of the lock bolts 4 into a lock bolt hole 61 formed on the housing 6 of an article to be locked. (FIG. 7 shows a notebook-type computer which is to be locked.) After the hook sections 43 of the lock bolts 4 are inserted and located in the lock bolt hole 61 of the housing 6, the user releases the press block 152 (as shown in FIG. 6) and the resilient member 25 resiliently pushes and restores the driving section 22 to its home position. At this time, the linking member 23 synchronously forward pushes one end of the pivoted plate 24, whereby the other end of the pivoted plate 24 pulls the driving member 3. At this time, the expansion section 51 of the core shaft 5 is synchronously pulled to slide inward relative to the two lock bolts 4 and abut against the hook sections 43 at outer ends thereof. Under such circumstance, the hook sections 43 are outward laterally extended to hook inner side of the lock bolt hole 61 of the housing 6. Then, the numeral wheels 21 are randomly turned to form a locked state.

The above operation can be reversely performed to draw the lock bolts 4 out of the lock bolt hole 61 of the housing 6 to unlock the article.

Figure 8:
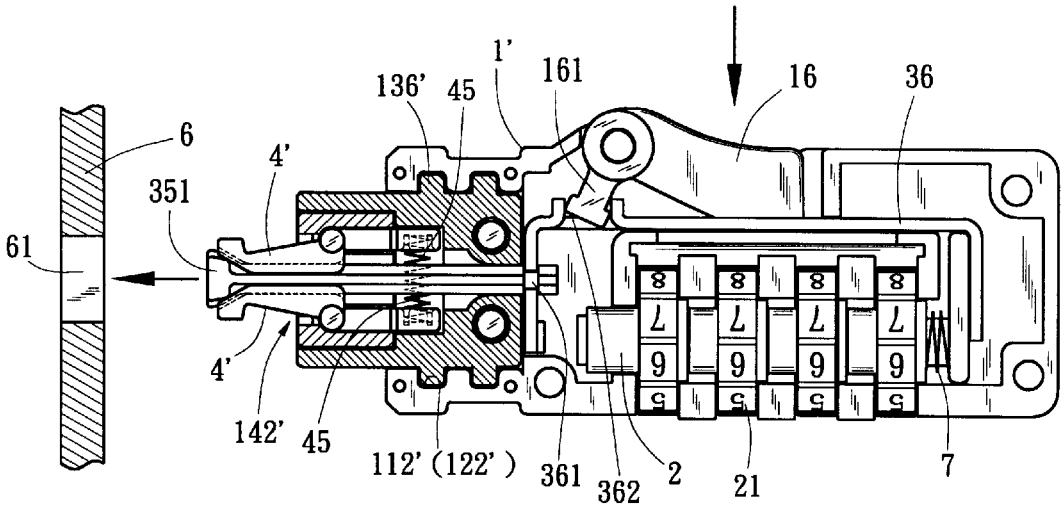
FIG. 8 is a sectional view showing another embodiment of the present invention in unlocked state.
Figure 9:
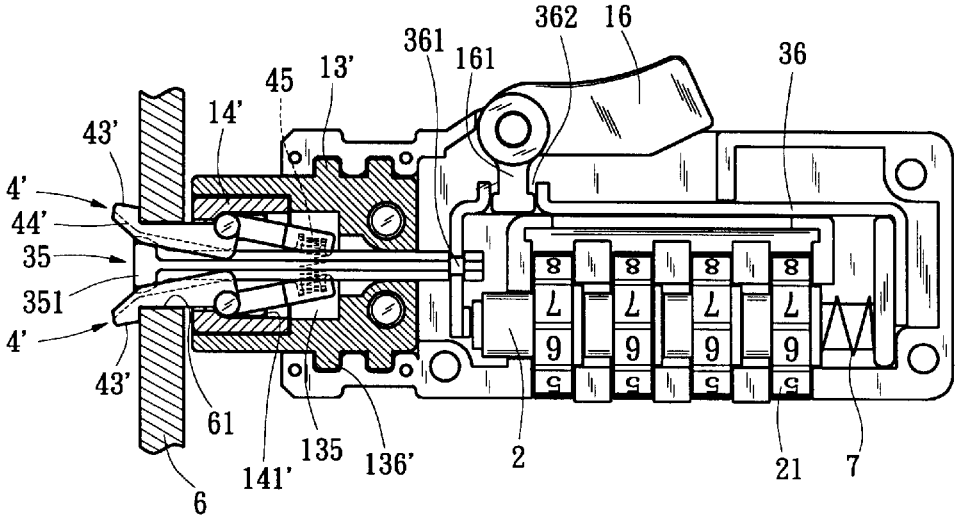
FIG. 9 is a sectional view showing another embodiment of the present invention in locked state.

FIGS. 8 and 9 show another embodiment of the present invention, in which a linking member 36 is fitted on outer side of the lock core 2 instead of the linking member 23, pivoted plate 24 and the driving member 3. One end section of the linking member 36 is formed with a notch 361 for fitting with the annular groove 352 of the core shaft 35 to connect therewith. The circumference of the linking member 36 is formed with a driven section 362. A press block 16 is pivotally disposed on the casing 1. The press block 16 has a transversely extending push section 161 coupled with the driven section 362. The rear end section 42 of the lock bolt 4' is provided with a resilient member 45 for outward pushing the lock bolt 4'. In use, when a user turns the respective numeral wheels 21 to correct position, the user can press the press block 16 to make the push section 161 forward push the core shaft 35, whereby the expansion section 351 relatively slides out of the front ends of the lock bolts 4'. At this time, the resilient member 45 pushes and makes the hook sections 43' of the lock bolts 4' close toward each other onto the core shaft 35 (as shown in FIG. 8). Under such circumstance, the user can extend the hook sections 43' of the lock bolts 4' into a lock bolt hole 61 formed on the housing 6 of an article to be locked. After the hook sections 43' of the lock bolts 4' are inserted and located in the lock bolt hole 61 of the housing 6, the user releases the press block 16. By means of a resilient member 7 positioned between one end of the lock core 2 and one end of the linking member 36, the linking member 36 is resiliently pushed and restored to its home position. At this time, the core shaft 35 is pulled and the expansion section 351 thereof is retracted to abut against and make the lock bolts 4' outward deflect. The hook sections 43 at outer ends of the lock bolts 4' are outward laterally extended to hook inner side of the lock bolt hole 61 of the housing 6 as shown in FIG. 9.

The front end of the inner stop member 13' is formed with a receptacle 135 for receiving therein the front cap 14' and the entire lock bolts 4'. The inner stop member 13' is further formed with a passage through which the core shaft 35 extends. The outer circumference of the inner stop member 13' is formed with annular insertion rib 136'. The inner wall of front end of the casing 1'is formed with annular grooves 112', 122' in which the annular rib 136' is inlaid. The inner stop member 13', front cap 14' and casing 1' are rotatable relative to each other.

According to the above arrangement, the lock bolts and lock body can be relatively rotated to enhance the torque strength of the lock bolts to avoid damage of the lock bolt hole of the locked article or damage of the steel cable lock due to external twisting force.

The above embodiments are only used to illustrate the present invention, not intended to limit the scope thereof. Many modifications of the above embodiments can be made without departing from the spirit of the present invention.

What is claimed is:

1. Steel cable lock structure comprising:

a casing for receiving therein a lock core and relevant driving members, an inner stop member being movably fitted near an inner side of one of the casing, the center of the inner stop member being formed with a perforation, through holes being formed beside the perforation, a front cap being fixedly connected with the inner stop member, the front cap being formed with a central through hole, at least one slot being formed beside the central through hole, whereby the inner stop member and the front cap are relatively pivotally rotatably connected with the casing;

at least one lock bolt connected with the front cap and having a rear end section extending inward into the through hole of the inner stop board member, the other end of the lock bolt extending outward from the front cap; and a linking member received in the casing and drivingly connected with the lock core, one end of the linking member being pivotally connected with a core shaft, whereby the linking member can axially push and pull the core shaft and the core shaft is rotatable relative to the linking member, the core shaft passing through the inner stop member and the front cap, the other end of the core shaft extending out of the front cap and being adjacent to the outward extending end of the lock bolt, whereby the core shaft can be driven by the linking member to achieve a locking effect for an external article to be locked, the inner stop member and the front cap are rotatable relative to the casing.

2. Steel cable lock structure as claimed in claim 1, wherein the front cap is connected with the front outer side of the inner stop member.

3. Steel cable lock structure as claimed in claim 1, wherein the front end of the inner stop member is formed with a receptacle for receiving therein the front cap and the lock bolt, an end of the receptacle being formed with a passage through which the rear end of the core shaft extends to pivotally connect with the linking member.

4. Steel cable lock structure as claimed in claim 1, wherein the outward extending end of the lock bolt is formed with a hook section which extends laterally.

5. Steel cable lock structure as claimed in claim 2, wherein the outward extending end of the lock bolt is formed with a hook section which extends laterally.

6. Steel cable lock structure as claimed in claim 3, wherein the outward extending end of the lock bolt is formed with a hook section which extends laterally.

7. Steel cable lock structure as claimed in claim 4, wherein the lock bolts are symmetrically positioned on two sides of the core shaft.

8. Steel cable lock structure as claimed in claim 5, wherein the lock bolts are symmetrically positioned on two sides of the core shaft.

9. Steel cable lock structure as claimed in claim 6, wherein the lock bolts are symmetrically positioned on two sides of the core shaft.

10. Steel cable lock structure as claimed in claim 1, wherein a middle portion of the lock bolt is formed with a pivot section which is pivotally connected in the slot of the front cap, whereby the lock bolt is pivotally rotatable about the slot as a lever.

11. Steel cable lock structure as claimed in claim 2, wherein a middle portion of the lock bolt is formed with a pivot section which is pivotally connected in the slot of the front cap, whereby the lock bolt is pivotally rotatable about the slot as a lever.

12. Steel cable lock structure as claimed in claim 3, wherein a middle portion of the lock bolt is formed with a pivot section which is pivotally connected in the slot of the front cap, whereby the lock bolt is pivotally rotatable about the slot as a lever.

13. Steel cable lock structure as claimed in claim 1, wherein an outer end of the core shaft is formed with a gradually widened expansion section, whereby when the core shaft is driven by the linking member to extend or retract, the outer ends of the lock bolts are pushed by the expansion section to expand or contract.

14. Steel cable lock structure as claimed in claim 2, wherein an outer end of the core shaft is formed with a gradually widened expansion section, whereby when the core shaft is driven by the linking member to extend or retract, the outer ends of the lock bolts are pushed by the expansion section to expand or contract.

15. Steel cable lock structure as claimed in claim 3, wherein an outer end of the core shaft is formed with a gradually widened expansion section, whereby when the core shaft is driven by the linking member to extend or retract, the outer ends of the lock bolts are pushed by the expansion section to expand or contract.

16. Steel cable lock structure as claimed in claim 1, wherein the linking member includes a driving member, a middle portion of the driving member being formed with an insertion slit, one end section of the driving member being formed with a boss section having a central through hole communicating with the insertion slit, the end of the core shaft with an annular groove extending through the through hole, an engaging plate having a notch on bottom side being inserted in the insertion slit and pivotally fitted on and connected with the annular groove of the core shaft, whereby when the boss section is pushed by the linking member, the boss section extends into the through hole of the inner stop member to abut against the rear end of the lock bolt.

17. Steel cable lock structure as claimed in claim 2, wherein the linking member includes a driving member, a middle portion of the driving member being formed with an insertion slit, one end section of the driving member being formed with a boss section having a central through hole communicating with the insertion slit, the end of the core shaft with the annular groove extending through the through hole, an engaging plate having a notch on bottom side being inserted in the insertion slit and pivotally fitted on and connected with an annular groove of the core shaft, whereby when the boss section is pushed by the linking member, the boss section extends into the through hole of the inner stop member to abut against the rear end of the lock bolt.

18. Steel cable lock structure as claimed in claim 16, wherein a shift member is slidably disposed on the surface of the casing, the shift member having a push section extending into the casing to press the lock core between the lock core and the driving member.

19. Steel cable lock structure as claimed in claim 17, wherein a shift member is slidably disposed on the surface of the casing, the shift member having a push section extending into the casing to press the lock core between the lock core and the driving member.

20. Steel cable lock structure as claimed in claim 1, wherein one end section of the linking member is formed with a notch for pivotally fitting with the annular groove of the core shaft to connect therewith, the linking member being drivingly connected with the lock core, whereby the linking member can drive the lock core to move back and forth, a rear end section of the lock bolt being provided with a resilient member for pushing the lock bolt outward, whereby the lock bolts are controlled to expand relative to the core shaft into a locking state or contract into an unlocking state.

21. Steel cable lock structure as claimed in claim 3, wherein one end section of the linking member is formed with a notch for pivotally fitting with an annular groove of the core shaft to connect therewith, the linking member being drivingly connected with the lock core, whereby the linking member can drive the lock core to move back and forth, a rear end section of the lock bolt being provided with a resilient member for pushing the lock bolt outward, whereby the lock bolts are controlled to expand relative to the core shaft into a locking state or contract into an unlocking state.

22. Steel cable lock structure as claimed in claim 20, wherein the circumference of the linking member is formed with a driven section, a press block being pivotally disposed on the casing, the press block having a transversely extending push section drivingly coupled with the driven section.

23. Steel cable lock structure as claimed in claim 20, wherein the circumference of the linking member is formed with a driven section, a press block being pivotally disposed on the casing, the press block having a transversely extending push section drivingly coupled with the driven section.

24. Steel cable lock structure as claimed in claim 1, wherein the circumference of core shaft is formed with axially extending lateral ribs, the lock bolts being formed with guide channels corresponding to the lateral ribs, the lateral ribs being slidably inserted in the guide channels, whereby the core shaft is inserted and connected between the lock bolts to enhance the torque strength of the lock bolt structure.

25. Steel cable lock structure as claimed in claim 2, wherein the circumference of core shaft is formed with axially extending lateral ribs, the lock bolts being formed with guide channels corresponding to the lateral ribs, the lateral ribs being slidably inserted in the guide channels, whereby the core shaft is inserted and connected between the lock bolts to enhance the torque strength of the lock bolt structure.

26. Steel cable lock structure as claimed in claim 3, wherein the circumference of core shaft is formed with axially extending lateral ribs, the lock bolts being formed with guide channels corresponding to the lateral ribs, the lateral ribs being slidably inserted in the guide channels, whereby the core shaft is inserted and connected between the lock bolts to enhance the torque strength of the lock bolt structure.

27. Steel cable lock structure as claimed in claim 1, wherein multiple numeral wheels control locking/unlocking of the lock core in the casing, the surface of the casing being formed with multiple wheel-turning windows through which the numeral wheels are partially exposed to an outer side for a user to turn the numeral wheels and control the lock core.

28. Steel cable lock structure as claimed in claim 2, wherein multiple numeral wheels control locking/unlocking of the lock core in the casing, the surface of the casing being formed with multiple wheel-turning windows through which the numeral wheels are partially exposed to an outer side for a user to turn the numeral wheels and control the lock core.

29. Steel cable lock structure as claimed in claim 3, wherein multiple numeral wheels control locking/unlocking of the lock core in the casing, the surface of the casing being formed with multiple wheel-turning windows through which the numeral wheels are partially exposed to an outer side for a user to turn the numeral wheels and control the lock core.

30. Steel cable lock structure as claimed in claim 1, wherein at least one resilient member is disposed between the casing and the inner stop member for pushing a ball body to abut against the inner stop member, one face of the inner stop member being formed with several locating dents in which the ball body is located.

31. Steel cable lock structure as claimed in claim 2, wherein at least one resilient member is disposed between the casing and the inner stop member for pushing a ball body to abut against the inner stop member, one face of the inner stop member being formed with several locating dents in which the ball body is located.

* * * * *